US009782879B2

(12) United States Patent
Bauer

(10) Patent No.: US 9,782,879 B2
(45) Date of Patent: Oct. 10, 2017

(54) PNEUMATIC NAILER COMPRISING A MANUALLY ACTUATABLE TRIGGER AND A CONTACT FEELER

(71) Applicant: Joh. Friedrich Behrens AG, Ahrensburg (DE)

(72) Inventor: Joachim Bauer, Bad Oldesloe (DE)

(73) Assignee: JOH. FRIEDRICH BEHRENS AG, Ahrensburg (DE)

( * ) Notice: Subject to any disclaimer, the term of this patent is extended or adjusted under 35 U.S.C. 154(b) by 794 days.

(21) Appl. No.: 14/183,572

(22) Filed: Feb. 19, 2014

(65) Prior Publication Data

US 2014/0231485 A1 Aug. 21, 2014

(30) Foreign Application Priority Data

Feb. 19, 2013 (EP) ..... 13000843

(51) Int. Cl.
*B25C 1/04* (2006.01)
*B25C 1/00* (2006.01)

(52) U.S. Cl.
CPC ..... *B25C 1/008* (2013.01); *B25C 1/04* (2013.01)

(58) Field of Classification Search
CPC ..... B25C 1/04; B25C 1/008
USPC ..... 173/90, 213, 46–47; 227/8
See application file for complete search history.

(56) References Cited

U.S. PATENT DOCUMENTS

| | | | | |
|---|---|---|---|---|
| 3,685,396 | A * | 8/1972 | Obergfell | F15B 11/15 91/356 |
| 3,964,659 | A | 6/1976 | Eiben et al. | |
| 4,384,668 | A * | 5/1983 | Tutomu | B25C 1/041 173/169 |
| 5,370,037 | A * | 12/1994 | Bauer | B25C 1/042 91/236 |
| 5,485,946 | A * | 1/1996 | Jankel | B25C 1/042 227/130 |
| 5,522,532 | A | 6/1996 | Chen | |
| 7,556,183 | B1 * | 7/2009 | Liang | B25C 1/041 227/112 |
| 2001/0009260 | A1 * | 7/2001 | Ishizawa | B25C 1/043 227/8 |
| 2002/0020374 | A1 * | 2/2002 | Buchel | B25C 1/08 123/90.15 |

(Continued)

*Primary Examiner* — Michelle Lopez
*Assistant Examiner* — Chinyere Rushing-Tucker
(74) *Attorney, Agent, or Firm* — Mayer & Williams, PC; Stuart H. Mayer

(57) ABSTRACT

A pneumatic nailer includes a working piston connected to a driving plunger for driving in a fastening means and which is subjected to compressed air when a driving-in process is triggered. The nailer also includes a triggering device which has a manually actuatable trigger and a contact feeler. Actuating the trigger and the contact feeler together activates a first control valve and can trigger a driving-in process. A second control valve is activated when actuating the trigger independently of an actuation of the contact feeler. A chamber is provided, which is either aerated or deaerated via a throttle when the second control valve is activated. A locking piston is provided which is displaced from a resting position into a locked position when the pressure in the chamber passes a predetermined pressure threshold and which in the locked position prevents a driving-in process from being triggered.

16 Claims, 4 Drawing Sheets

(56) References Cited

U.S. PATENT DOCUMENTS

| | | | | |
|---|---|---|---|---|
| 2007/0131731 | A1* | 6/2007 | Moeller | B25C 1/08 227/10 |
| 2007/0251972 | A1* | 11/2007 | Lee | B25C 1/043 227/130 |
| 2010/0252608 | A1* | 10/2010 | Lai | B25C 1/047 227/8 |

* cited by examiner

PNEUMATIC NAILER COMPRISING A MANUALLY ACTUATABLE TRIGGER AND A CONTACT FEELER

BACKGROUND OF THE INVENTION

The invention relates to a pneumatic nailer comprising a working piston which is connected to a driving plunger for driving in a fastening means and which is subjected to compressed air when a driving-in process is triggered and a triggering device which has a manually actuatable trigger and a contact feeler, wherein actuating the trigger and contact feeler together activates a first control valve and can trigger a driving-in process.

Such pneumatic nailers are known from the prior art. The contact feeler is a mechanical component which is held by a spring in a position protruding over a mouth tool of the pneumatic nailer. If the pneumatic nailer is applied to a workpiece, the contact feeler is displaced against the force of the spring until the mouth tool bears against the workpiece. A driving-in process can only be triggered when the contact feeler is actuated in this manner. As a result, the known pneumatic nailers provide considerably improved safety against inadvertent triggering relative to devices without a contact feeler.

Pneumatic nailers with a triggering device of the type described above can be used in two different operating modes. In so-called single trigger actuation, the pneumatic nailer is initially applied to a workpiece and as a result the contact feeler is actuated. Subsequently, the trigger is manually actuated and, as a result, a single driving-in process is initiated.

In so-called contact trigger actuation, also denoted as "touching", the user is already holding the trigger down while applying the pneumatic nailer to the workpiece. When applied to the workpiece, the contact feeler is actuated and as a result a driving-in process is triggered. The pneumatic nailer can be applied repeatedly and in quick succession which permits very rapid operation, in particular when many fastening means have to be driven in for adequate fastening, only low requirements being set for the positional accuracy thereof.

In certain situations, however, an increased risk of injury results from the contact trigger actuation method. If the user holds down the manually actuated trigger, for example, not only when it is desired to apply the pneumatic nailer to one and the same workpiece at intervals of a few centimeters from the previously driven-in fastening means, but also when the user changes to a different workpiece potentially arranged at a distance therefrom, a driving-in process can be triggered by inadvertent contact of an object or body part with the contact feeler. For example, this can lead to accidents when a user (ignoring important safety rules) climbs on a ladder with the pneumatic nailer, at the same time holds the trigger down and inadvertently touches the contact feeler with his or her leg.

SUMMARY OF THE INVENTION

Proceeding therefrom, it is the object of the invention to improve a pneumatic nailer of the type mentioned in the introduction such that it can still be used with the contact trigger actuation method but such that it provides a greater degree of safety against being inadvertently triggered.

This object is achieved by the pneumatic nailer having the features of claim 1. Advantageous embodiments are set forth in the accompanying sub-claims.

The pneumatic nailer comprises

- a working piston which is connected to a driving plunger for driving in a fastening means and which is subjected to compressed air when a driving-in process is triggered,
- a trigger device which has a manually actuatable trigger and a contact feeler, wherein actuating the trigger and the contact feeler together activates a first control valve and can trigger a driving-in process,
- a second control valve which is activated when actuating the trigger independently of an actuation of the contact feeler,
- a chamber which is either aerated or deaerated via a throttle when the second control valve is activated, and
- a locking piston which is displaced from a resting position into a locked position when the pressure in the chamber passes a predetermined pressure threshold and which in the locked position prevents the driving-in process from being triggered.

The pneumatic nailer is used for driving in fastening means such as nails, tacks or staples. To this end, the pneumatic nailer can have a magazine for the fastening means, from which one respective fastening means is supplied to a receiver of a mouth tool of the pneumatic nailer.

Both the drive and the control of the pneumatic nailer can take place entirely pneumatically and a supply of electrical energy is therefore not necessary.

When triggering a driving-in process, a working piston of the pneumatic nailer is subjected to compressed air. In this case, the working piston drives a driving plunger which is connected to the working piston. The driving plunger comes into contact with a rear end of the fastening means in the receiver of the mouth tool and drives the fastening means into the workpiece.

The triggering device has a manually actuatable trigger, for example in the form of a tumbler switch or slide button and a contact feeler. The contact feeler can be a mechanical component which protrudes over the front end of the mouth tool and is held by a spring in this position until the pneumatic nailer is applied to a workpiece. Then the contact feeler is displaced counter to the direction of the spring force and counter to the driving-in direction. If this actuation of the contact feeler takes place together with an actuation of the trigger, a first control valve is activated whereby a driving-in process can be triggered.

When the trigger and the contact feeler are actuated together, the first control valve is activated. If only the manually actuatable trigger or the contact feeler is actuated, the first control valve is not activated. For actuating the trigger and the contact feeler together it is sufficient if at a specific time both the trigger and the contact feeler are simultaneously in the actuated state. This can be achieved, on the one hand, by simultaneous actuation but also in any sequence. For example, as is typical for single trigger actuation, the contact feeler can be initially actuated and then the manually actuatable trigger can be actuated. In contact trigger actuation, however, initially the manually actuatable trigger can be actuated and then the contact feeler.

The activation of the first control valve can be achieved by a mechanical coupling of the manually actuatable trigger and the contact feeler. For example, a control pin of the first control valve can only be displaced when actuating the trigger and contact feeler together and as a result the first control valve can be activated.

The activation of the first control valve can trigger a driving-in process. According to the invention, this takes place when the locking piston is in its resting position. If the locking piston is in its locked position, however, the triggering of a driving-in process is prevented when the first control valve is activated.

According to the invention, a second control valve is activated when the manually actuatable trigger is actuated, independently of an actuation of the contact feeler. The second control valve is thus activated with every actuation of the trigger. To this end, for example, a control pin of the second control valve can be arranged so that it is displaced from its resting position with every actuation of the trigger.

With such an activation of the second control valve, a chamber is aerated or deaerated via a throttle. "Aerated" is always understood to be that a connection is made to a space conveying compressed air. "Deaerated" is always understood to be that a connection is made to a unpressurised space, in particular to the outside air.

According to the invention, when activating the second control valve, whether the chamber is aerated or deaerated depends on the construction of the pneumatic nailer: in a pneumatic nailer, the chamber thereof being aerated when the second control valve is activated, the pneumatic nailer has a line which connects the chamber to a space conveying compressed air. In a pneumatic nailer, the chamber thereof being deaerated when the second control valve is activated, the pneumatic nailer has a line which connects the chamber to an unpressurised space, in particular to the outside air. In both cases, the throttle and the second control valve can be located in the respective line. If the chamber is to be aerated, in an initial state of the pneumatic nailer the chamber is unpressurised. When activating the second control valve, air then flows in via the throttle, so that the pressure increases in the chamber. If the chamber is to be deaerated, it is subjected to increased pressure in an initial state of the pneumatic nailer. When activating the second control valve, the air located in the chamber slowly flows out via the throttle, so that the pressure in the chamber is reduced.

In both cases, after a certain time the pressure in the chamber passes a predetermined pressure threshold. When a chamber is aerated by activating the second control valve, the pressure exceeds the pressure threshold. When a chamber is deaerated when activating the second control valve, the pressure is reduced below the predetermined pressure threshold. In both cases, the passing of the predetermined pressure threshold results in the locking piston being displaced from a resting position into a locked position. In the locked position, the triggering of a driving-in process is prevented.

Thus, according to the invention a driving-in process can only be triggered after the actuation of the trigger, as long as the pressure in the chamber has not yet passed the predetermined pressure threshold. If the trigger is, therefore, actuated for a longer period of time and as a result the pressure in the chamber has passed the pressure threshold, actuating the contact feeler does not result in triggering a driving-in process, as this is prevented by the locking piston then being located in the locked position. It is thus prevented that a driving-in process is triggered, by an actuation of the contact feeler only taking place a long time after the trigger is actuated. As a result, most cases of inadvertent triggering, in which the user has actuated the trigger longer than necessary due to carelessness, can be reliably prevented.

In an embodiment, the chamber is deaerated or respectively aerated when the trigger is not actuated. If the pneumatic nailer has a chamber which is aerated when the second control valve is activated, the chamber is deaerated when the trigger is not actuated. If the pneumatic nailer has a chamber which is deaerated when the second control valve is activated, the chamber is aerated when the trigger is not actuated. The deaeration or respectively aeration of the chamber when the trigger is not actuated can take place via the second control valve, optionally also via the second control valve and the throttle. In this case, the line used when activating the second control valve for aeration or respectively deaeration of the chamber, in which also the throttle is arranged, can also be used for deaeration or respectively aeration of the chamber when the trigger is not actuated.

In any case, the aforementioned embodiment results in the desired pressure, corresponding to an initial state of the pneumatic nailer, being present in the chamber when the trigger is not actuated. As a result, when the trigger is not actuated the pneumatic nailer is in any case always in its initial state after a certain period of time. If the throttle is also in the line used for deaeration or respectively aeration of the chamber when the trigger is not actuated, said initial state is only reached again after a certain period of time, if previously the pressure in the chamber had passed the predetermined pressure threshold. If a user, therefore, had previously actuated the trigger for a lengthy time so that the pressure threshold had been passed, a further driving-in process by actuating the contact feeler could only take place when the trigger had remained unactuated for a certain period of time. Until then, the pneumatic nailer is locked. If said locked state is perceived by a user as troublesome, this can counteract inadvertent continuous actuation of the trigger in the future and thus further improve the safety of the use of the pneumatic nailer.

In an embodiment, an opening cross section of the throttle is dimensioned such that during operation of the pneumatic nailer at an operating pressure provided therefor, the pressure in the chamber passes the predetermined pressure threshold in a time period of 0.1 s to 10 s after the second control valve is activated. In particular, the pressure threshold can be passed after activation of the second control valve in a time period of between 1 s and 5 s, for example after approximately 4 s. The opening cross section of the throttle can be adjustable so that the time period can be individually adjusted. Preferably, this adjustment is carried out only once by the manufacturer of the pneumatic nailer and is only able to be altered by unauthorized intervention by a user. In any case, the pneumatic nailer is locked in good time in order to prevent in many typical usage situations a driving-in process as a result of inadvertent actuation of the contact feeler.

In an embodiment, the pneumatic nailer has a valve via which the chamber is deaerated or respectively aerated when a driving-in process is triggered. If the chamber is aerated when the second control valve is activated, it is to be deaerated when a driving-in process is triggered. If the chamber is deaerated when the second control valve is activated, it is to be aerated when a driving-in process is triggered. As a result, when triggering a driving-in process, the initial state is created again with regard to the pressure in the chamber. This can take place very rapidly. If, after the driving-in process, the trigger is still held down, in the manner set forth in the introduction, the pressure in the chamber again approaches the pressure threshold which is passed after the predetermined time period. Until then, further triggering is possible at any time by actuating the contact feeler, so that the pneumatic nailer is suitable without limitation for driving-in processes in rapid succession using a contact trigger actuation method.

In an embodiment, when a driving-in process is triggered, a control chamber is deaerated or respectively aerated as a result of the first control valve being activated, wherein the valve is a non-return valve which connects the chamber to the control chamber. The control chamber can, in particular, be located in or on a pilot valve by which a main valve which is appropriate for aerating the working cylinder is activated. Also, it can be a control chamber in or on the main valve. In order to trigger a driving-in process, the pressure in the control chamber has to be altered. This takes place by deaeration or respectively aeration, as a result of activating the first control valve. In this embodiment, the valve which is responsible for recreating the initial state in the chamber when a driving-in process is triggered is a non-return valve which connects the chamber to the control chamber. If the pressure in the control chamber corresponds to an initial state of the pneumatic nailer, the non-return valve is closed, so that the pressure in the chamber approaches the pressure threshold in the desired manner when the second control valve is actuated. If a driving-in process is triggered, the pressure in the control chamber alters, the non-return valve opens and the pressure in the chamber adopts the initial state again.

In an embodiment, the non-return valve has an O-ring which is arranged in an internal groove of a sleeve and closes a bore leading from the internal groove to an outer face of the sleeve. The sleeve can, for example, be a guide sleeve for a control piston of a pilot valve. The cited embodiment of the non-return valve permits a particularly compact design.

In an embodiment, the locking piston in the locked position switches the pneumatic nailer to the fully unpressurized state. To this end, the locking piston can be arranged so that it activates one or more further valves by which a central compressed air connection of the device is blocked and the interior of the pneumatic nailer is completely deaerated. This solution is relatively costly in terms of construction but reliably prevents a further driving-in process from being able to be triggered. Moreover, in particular, the complete deaeration of the pneumatic nailer does not remain unnoticed so that the user is made aware of the continuous actuation of the trigger which is not optimal for safety reasons.

In an embodiment, the locking piston in the locked position closes a deaeration opening via which a control chamber is deaerated when a driving-in process is triggered. The deaeration of the control chamber required for triggering the driving-in process is therefore not able to take place. In this manner, inadvertent triggering can also be reliably prevented.

In an embodiment, the locking piston blocks a line which is aerated or respectively deaerated when the first control valve is activated. The line can, for example, connect a control chamber, which has to be aerated or deaerated for triggering a driving-in process, to the first control valve. By the blocking of this line with the locking piston, the activation of the first control valve no longer has the required effect of triggering a driving-in process. As a result, the triggering of an inadvertent driving-in process is prevented.

In an embodiment, the locking piston is configured to interrupt a non-positive connection between the contact feeler and the first control valve. By this interruption, the first control valve, i.e. when actuating the contact feeler, is no longer actuated when the trigger is actuated.

In particular, a mechanical coupling between the contact feeler and the first control valve can be released by the locking piston. This can be achieved, for example, by a three-part coupling between the contact feeler and the first control valve, wherein the force exerted on the contact feeler is forwarded via all three parts to the first control valve. The displacement of the locking piston into the locked position can, for example, move the central part of the three parts out of its position required for force transmission. Inadvertent triggering can also be prevented in this manner.

In an embodiment, the locking piston is pretensioned by a spring in the locked position. In order to bring the locking piston into its resting position, in which the pneumatic nailer can be triggered, the locking piston has to be displaced against the force of the spring. If the pressure build-up required therefor is not present as a result of malfunction of the pneumatic nailer, a triggering of the device is thus not possible. A locking piston pretensioned in the locked position is thus particularly safe.

In an embodiment, the locking piston, in the locked position, blocks a valve element to be moved for triggering a driving-in process. The movement of the valve element required for triggering a driving-in process is thus prevented and thus also inadvertent triggering. The blocking of a valve element requires a relatively small degree of force expenditure and accordingly permits a simple and robust construction of the locking piston. In contrast to a blocking of a control line with the locking piston or for actuating a specific valve, no additional seals are required for blocking the valve element which is present. This also promotes a particularly simple and safe construction.

In an embodiment, the valve element to be moved is a control piston of a pilot valve. The advantages set forth in connection with the blocking of a valve element to be moved for triggering a driving-in process apply specifically to the control piston of a pilot valve.

In an embodiment, the valve to be moved is a main valve-actuating member which closes a working volume above the working piston. If a movement of the main valve-actuating member is blocked by the blocking piston, triggering is excluded.

In an embodiment, the locking piston is guided in a cylinder and the cylinder chamber arranged on a first side of the locking piston is connected to the chamber or forms the chamber. In both cases, the cylinder chamber contributes to the volume of the chamber. In order to increase the volume of the chamber further, the locking piston can be of hollow design. The larger the volume of the chamber, the easier it is to achieve a sufficient limit to the airflow through the throttle.

In an embodiment, a second side of the piston opposing the first side of the locking piston is subjected to compressed air in an initial state of the pneumatic nailer. "Initial state" is always understood as a state in which the pneumatic nailer is connected to a compressed air supply and neither the contact feeler nor the trigger are actuated. The locking piston is forced into its resting position by means of the second side of the piston subjected to compressed air. This embodiment is particularly advantageous for a chamber to be aerated when the second control valve is activated. In the case of any leakage in the region of the seal of the locking piston, the chamber is additionally aerated via the leakage point which leads to the predetermined pressure threshold being prematurely exceeded and thus the pneumatic nailer being locked. This is advantageous for safety considerations, as the failure of the seal is immediately noticed. Otherwise, a leakage in the chamber could easily remain unnoticed due to the throttle arranged upstream and the pneumatic nailer could continue to be operated, in spite of the resulting failure of the safety mechanism according to the invention.

BRIEF DESCRIPTION OF THE DRAWINGS

The invention is described in more detail hereinafter with reference to an exemplary embodiment shown in four figures, in which.

DETAILED DESCRIPTION OF THE INVENTION

Figure 1:
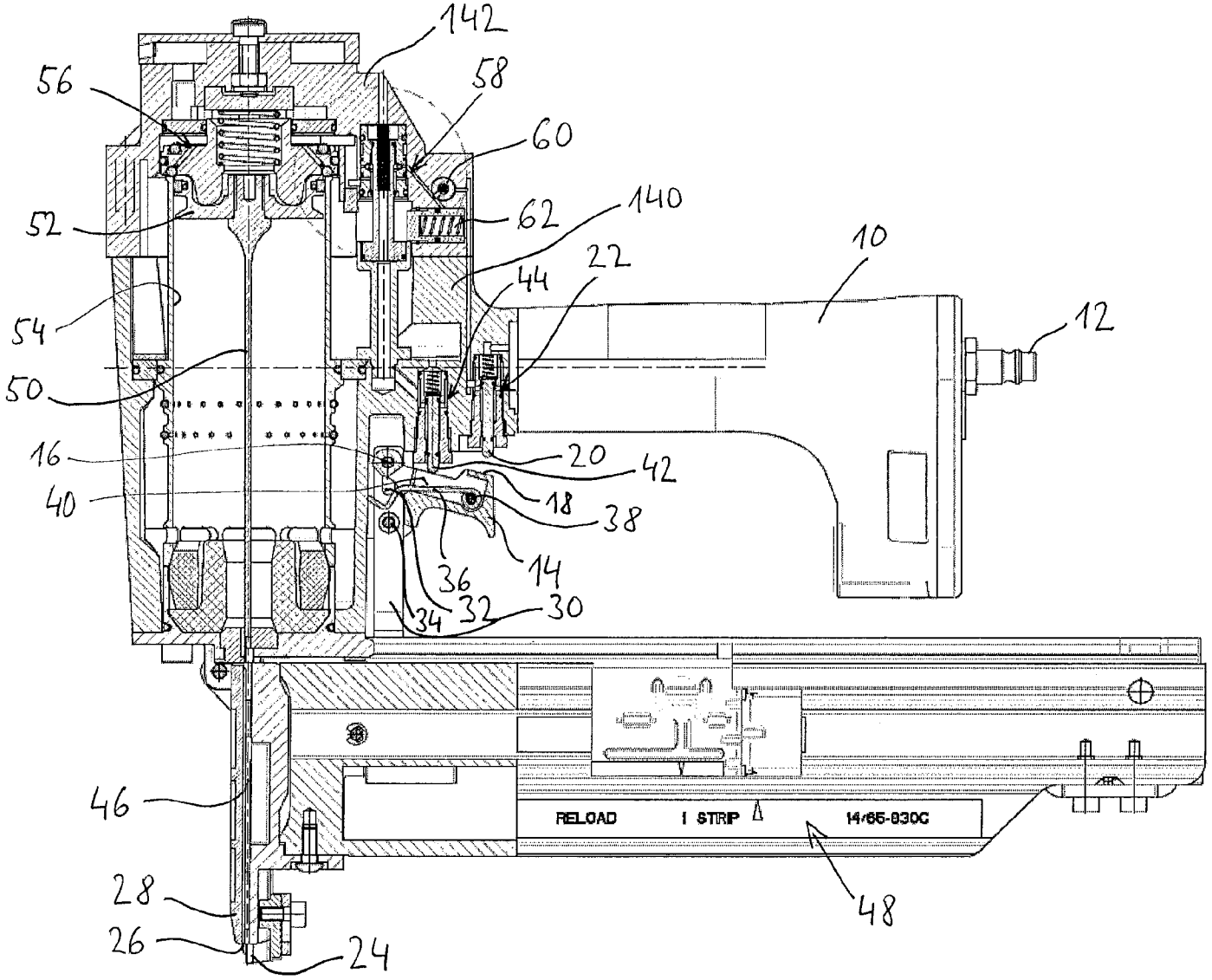
FIG. 1 shows a pneumatic nailer according to the invention in a partially sectional view.

Firstly, with reference to FIG. 1, the most essential elements of the pneumatic nailer are shown partially in the manner of an overview. The pneumatic nailer has a handle 10, a central compressed air connection 12 being arranged at the rear end thereof. The handle 10 is located on a lower housing part 140 which is closed at the top by a housing cap 142.

The manually actuatable trigger 14 is pivotably mounted about a pivot axis 16 on the housing of the pneumatic nailer and arranged such that it can be actuated comfortably by the index finger of a user holding the pneumatic nailer by the handle 10. During this actuation, a switching surface 18 arranged on the upper face of the trigger 14, comes to bear against a switching pin 20 of a second control valve 22, displaces the switching pin 20 upward and as a result activates the second control valve 22. As this activation of the second control valve 22 is effected immediately by the switching surface 18 arranged fixedly on the trigger 14, it takes place independently of the actuation of a contact feeler 24.

In the initial state of the pneumatic nailer shown in all of the figures, the contact feeler 24 protrudes downward over the mouth 26 of a mouth tool 28 by a few millimeters. If the pneumatic nailer is applied to a workpiece, the contact feeler 24 is displaced upward against the force of a spring, not shown, until it terminates flush with the mouth 26. The contact feeler 24 is mechanically coupled to a force transmission element 30 which is driven upward with the movement of the contact feeler 24. The force transmission element 30 is movably guided on the housing of the pneumatic nailer and has a slot 32 through which the pivot axis 16 of the trigger 14 is passed.

When actuating the contact feeler 24, the force transmission element 30 is displaced upward from the initial position shown and at the same time, with a stop pin 34 fastened to the force transmission element 30, drives the free end of a lever 36, the fixed end thereof being pivotably articulated in the interior of the trigger 14 and in the vicinity of the free end thereof. The lever 36 is thus arranged approximately parallel to the longitudinal direction of the trigger 14 and its upper face acts as a switching surface 40 which, when the contact feeler 24 and the trigger 14 are actuated together, displaces a switching pin 42 of a first control valve 44 upward and thus activates the first control valve 44.

The mouth tool 28 has a receiver 46 to which one respective fastening means is supplied from a magazine 48. From this position within the receiver 46, the fastening means—for example a nail, a tack or a staple—is driven in by a driving plunger 50 which is connected to a working piston 52 of the pneumatic nailer. To this end, the working piston 52 is guided in a working cylinder 54. Above the working cylinder 54, and closing said working cylinder sealingly, a main valve 56 is arranged, to the right thereof a pilot valve 58 and again to the right thereof a throttle 60 and a chamber 62. Details of these elements and the function of the device are described in more detail with reference to the enlarged details of FIGS. 2 to 4.

Figure 2:
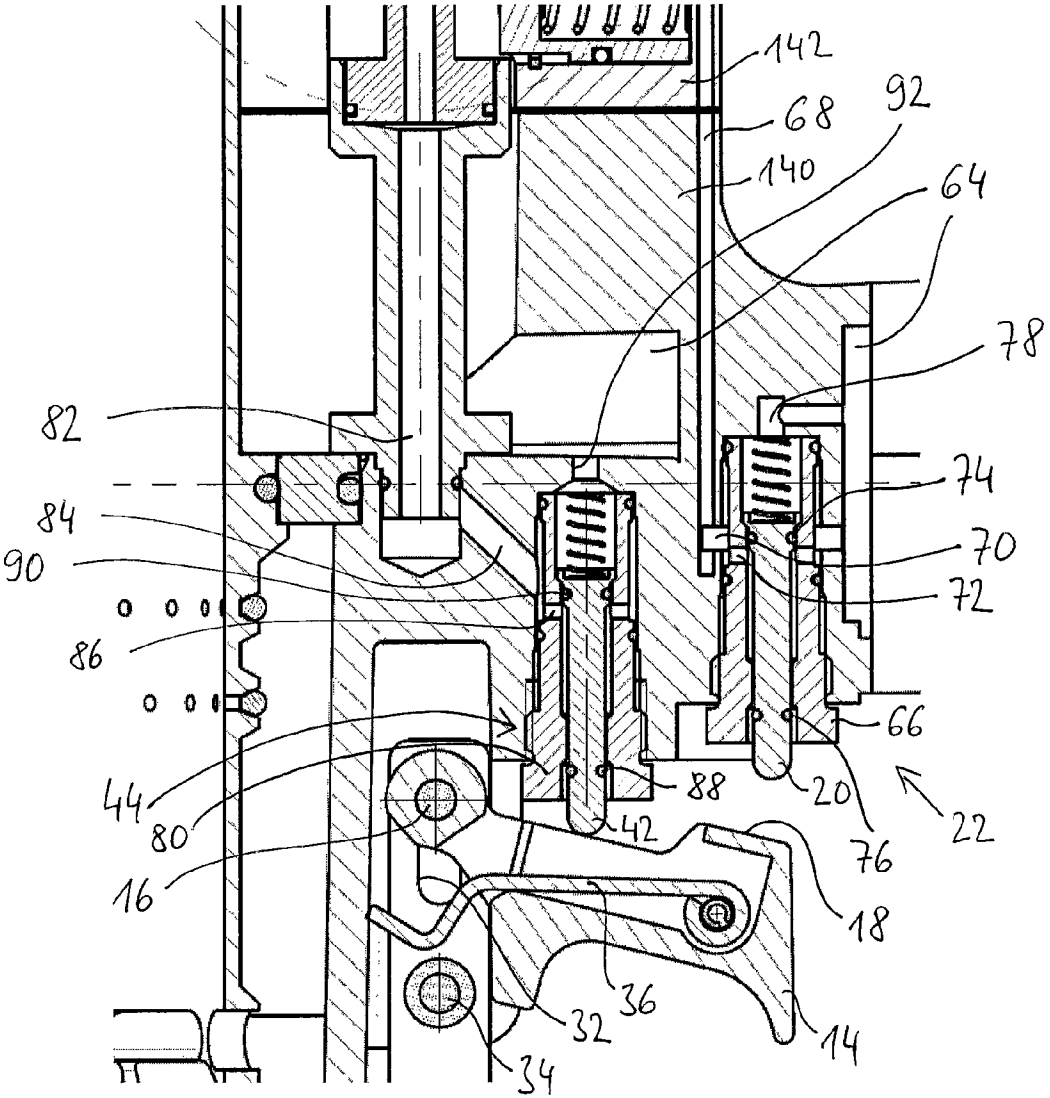
FIG. 2 shows an enlarged detail from FIG. 1 with the manually actuatable trigger as well as the first and second control valves.

Clearly visible in FIG. 2 is the manually actuatable trigger 14 with the lever 36 mounted therein and the switching surface 18. The switching pin 20 of the second control valve 22 is guided in a sleeve 66 of the second control valve 22 inserted in the housing and sealed relative thereto. The housing of the pneumatic nailer has a housing interior 64 which is aerated in the initial state of the pneumatic nailer, i.e. connected to the compressed air connection 12 and at operating pressure.

A second control line 68 is connected via an annular gap 70 to radial bores 72 of the second control valve 22. In the non-actuated state shown of the second control valve 22, an upper O-ring 74 of the second control valve 22 seals the control pin 20 relative to the sleeve 66 so that a connection to a line 78 which is connected to the housing interior 64 is blocked. At the same time, a lower O-ring 76 of the second control valve 22 is not sealed so that the radial bores 72 and thus the second control line 68 are connected to the outside air via the annular gap between the switching pin 20 and the sleeve 66. In the non-actuated state of the second control valve 22, the second control line 68 is thus deaerated.

With each actuation of the trigger 14, the switching pin 20 is displaced upward by the switching surface 18 so that the upper O-ring 74 moves out of the sealed position and the lower O-ring 76 seals the switching pin 20 relative to the sleeve 66. As a result, the connection of the second control line 68 to the outside air is blocked. At the same time, the second control line 68 is connected via the radial bores 72 to the line 78 and thus aerated.

The switching pin 42 of the first control valve 44 is also guided in a sleeve 80 inserted into the housing and sealed relative thereto. When the trigger 14 and the contact feeler 24 are actuated together, the switching pin 42 of the first control valve 44 is activated via the lever 36. In the non-activated state shown of the first control valve 42, a first control line 82, which serves for activating the pilot valve 58 (more in connection with FIGS. 3 and 4), is deaerated and namely via an obliquely arranged bore 90 in the housing of the pneumatic nailer and two radial bores 86 in the sleeve 80 of the first control valve 44. The radial bores 86 are connected via an annular gap between the sleeve 80 and the switching pin 42 of the first control valve 44 to the outside air, provided the lower O-ring 88 of the first control valve 44 is not in a sealed position, corresponding to the initial state as shown in FIG. 2. In the non-activated state of the first control valve 44, an upper O-ring 90 which is arranged above the radial bores 86, is in a sealed position and thus blocks a connection via a line 92 to the housing interior 64.

When the first control valve 44 is actuated, the lower O-ring 88 moves into the sealed position and blocks the connection of the first control line 42 from the outside air. At the same time, the upper O-ring 90 moves out of the sealed position, so that the first control line 82 is connected via the obliquely arranged bore 84, the radial bores 86 and the line 92 to the aerated housing interior 64.

Figure 3:
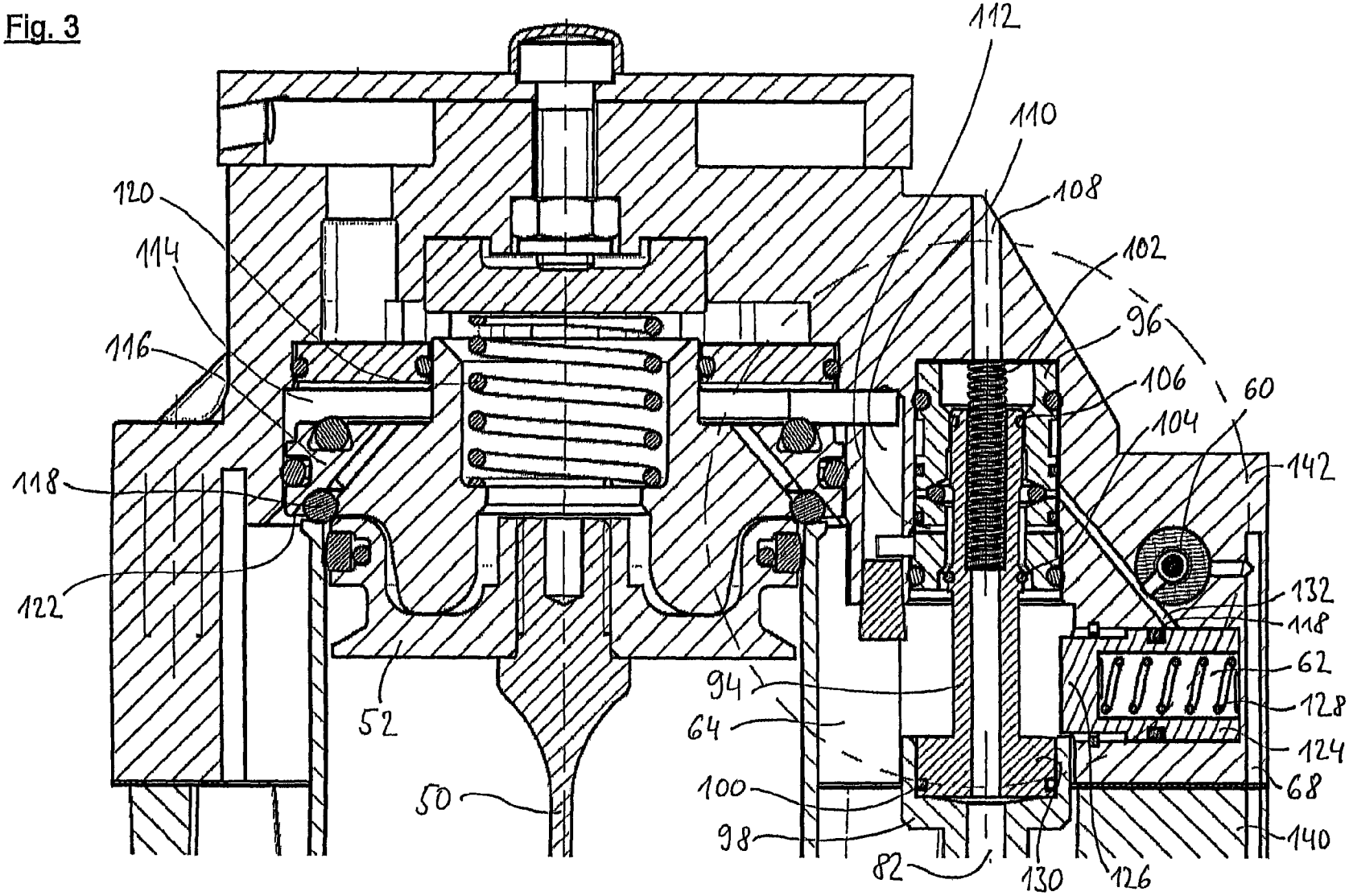
FIG. 3 shows a further enlarged detail from FIG. 1 with the pilot valve and the main valve.

The pilot valve 58 is able to be seen most clearly in FIG. 3. It has a control piston 94 which is guided in a guide sleeve 96. The lower end of the control piston 94 is guided in an intermediate sleeve 98 connected fixedly to the housing and sealed relative thereto by an O-ring 100. In the initial state of the pneumatic nailer, i.e. when the first control line 82 is deaerated, the control piston 94 is located in the lower position shown. In this position, it is held by the force of a spring 102.

The control piston 94 has a central O-ring 104 and an upper O-ring 106 in addition to the lower O-ring 100. In the lower position shown of the control piston 94, the upper O-ring 106 seals the control piston relative to the guide sleeve 96 and, as a result, closes a connection to the deaeration opening 108 which is connected to the outside air. The central O-ring 104 is not in the sealed position so that a main control line 110 is connected to the aerated housing interior 64 via radial bores 112 in the guide sleeve 96 and the annular gap between the control piston 94 and the guide sleeve 96 past the central O-ring 104.

The main control line 110 is connected to a space 114 above an actuating member 116 of the main valve 56, so that the actuating member 116 is subjected to a downward force and, as a result, seals the upper edge of the working cylinder 54 by means of a further O-ring 118 relative to the housing interior 64. Additionally, the actuating member 116 is subjected by a spring 120 to a force in the direction of said position closing the working cylinder 54.

If the first control valve 44 is actuated and, as a result, the first control line 82 is aerated, the control piston 94 is displaced upward so that the lower O-ring 104 is in the sealed position and the upper O-ring 106 moves out of the sealed position. As a result, the connection of the main control line 110 to the housing interior 64 is blocked and at the same time a connection is formed with the deaeration opening 108. The space 114 above the actuating member 116 is deaerated via the deaeration opening 108 and the actuating member 116 is displaced upward by the pressure present on its lower outer annular surface 122, which prevails in the housing interior, against the force of the spring 120. As a result, compressed air flows out of the housing interior 64 into the working cylinder 54 above the working piston 52 and drives the working piston 52 downward. With this downward movement, the driving plunger 50 connected to the working piston 52 drives in a fastening means.

In FIG. 3 to the right of the control piston 94, a locking piston 124 is shown horizontally guided in the bore of the housing cap 142. It is shown in a resting position, corresponding to the initial position of the pneumatic nailer, in which it is located to the right in FIG. 3. In this resting position, an end 126 of the locking piston 124 is at a distance from the control piston 94 and in the case of aeration of the first control line 82 does not collide with the upward movement of the control piston 94.

The locking piston 124 is of hollow configuration and its interior forms the chamber 62 together with the annular gap around the locking piston 124, located in FIG. 3 to the right of the O-ring 126 of the locking piston 124. A spring 128 is arranged in the chamber 62 within the locking piston 124, said spring subjecting the locking piston 124 to a force which drives it into its locked position which is displaced to the left relative to the resting position shown. In this locked position (not shown) the end 126 of the locking piston 124 protrudes into the operating path of a lower portion 130 of the control piston 94 which is widened in diameter, so that a displacement of the control piston 94 to be moved upward for triggering a driving-in process is prevented.

The second control line 68 coming from the second control valve 22 is connected via a throttle 60 and an obliquely extending bore 132 to the chamber 62. An aeration of the second control line 68 as a result of an actuation of the second control valve 22 thus results in a slow aeration of the chamber 62 via the throttle 60. If the pressure in the chamber 62 exceeds a predetermined pressure threshold, the forces exerted by the spring 128 and the pressure in the chamber 62 on the locking piston 124 in the direction of its locked position are greater than the forces exerted on the left-hand surface of the locking piston 124 by the pressure in the housing interior 64 to the right, i.e. in the direction of its resting position, and the locking piston 124 is displaced into its locked position. As a result, the triggering of a driving-in process is prevented as soon as the pressure in the chamber 62 exceeds the predetermined pressure threshold.

Figure 4:
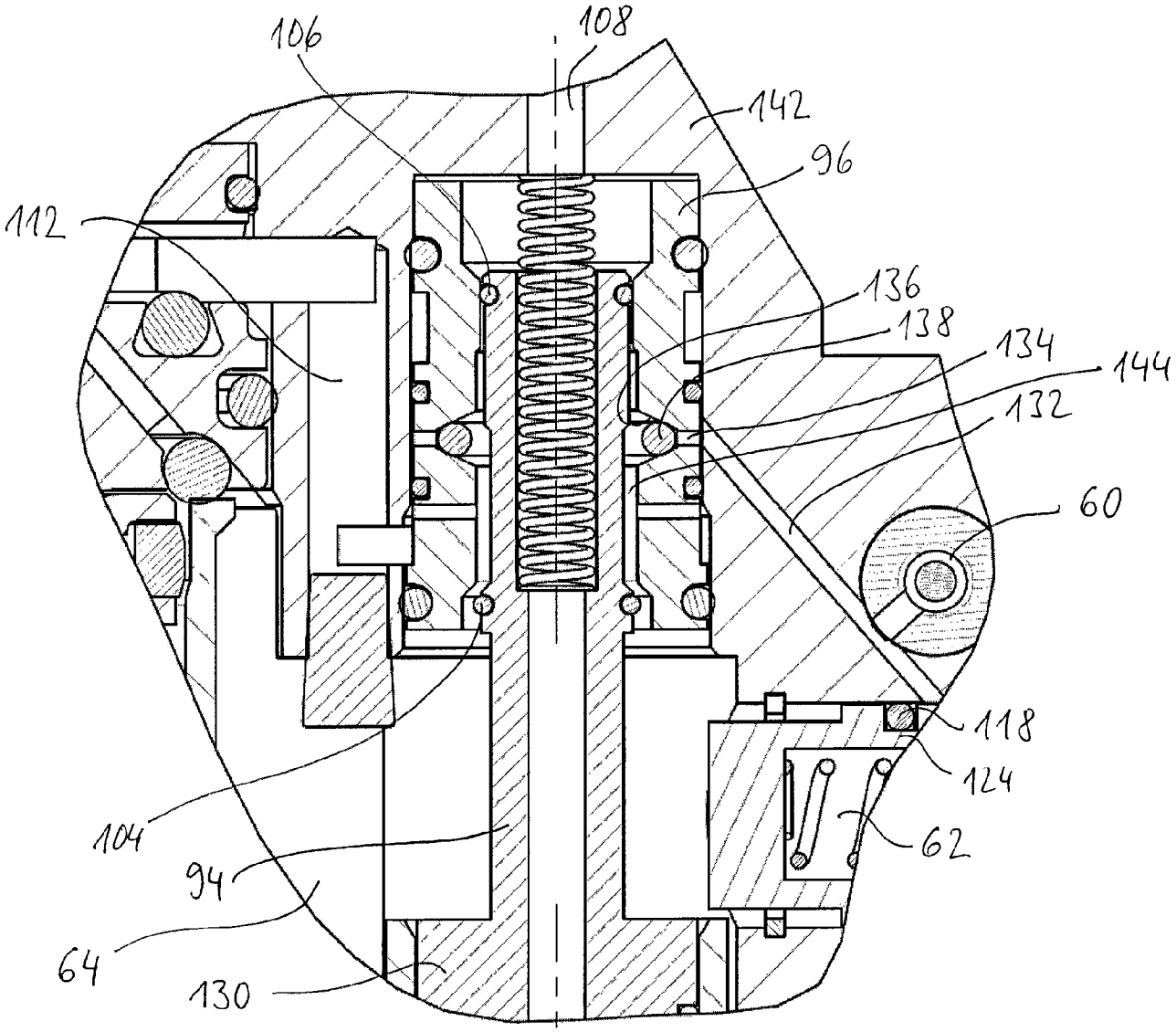
FIG. 4 shows a further enlarged detail from FIG. 1 with essential elements of the pilot valve.

Further details are able to be seen most clearly in FIG. 4. Here it may be seen that the obliquely arranged bore 132, which is aerated via the throttle 60, leads on one side of the throttle 60 to the chamber 62 and continues on the other side as far as a radial bore 134 in the guide sleeve 96 of the pilot valve 58. This radial bore 134 is connected to an internal groove 136 in the internal bore of the guide sleeve 96. The internal groove 136 is located between the upper O-ring 106 and the central O-ring 104 of the control piston 94. An O-ring 138 is arranged in the internal groove 136, said O-ring forming a non-return valve which seals the radial bore 134 relative to the annular gap between the control piston 94 and the guide sleeve 96.

In the initial state shown in FIG. 4, the central O-ring 104 is not in the sealed position so that the annular gap forming a control chamber 144 is connected to the housing interior 64 and is subjected to compressed air. The pressure in the radial bore 134 corresponds to the pressure inside the chamber 62 so that the O-ring 138 is forced into the internal groove 136 and the radial bore 134 is closed.

When triggering a driving-in process, the control piston 94 is displaced upward and the annular gap between the control piston 94 and the guide sleeve 96 is, as already mentioned, deaerated via the deaeration opening 108. Then the pressure in the chamber 62 and thus in the radial bore 134 is greater than in the annular gap between the control piston 94 and the guide sleeve 96 and the O-ring 138 moves inward, whereby the non-return valve opens and the chamber 62 is deaerated via the obliquely extending bore 132 and the radial bore 134. In this manner, when triggering a driving-in process, the unpressurized initial state in the chamber 62 is automatically recreated so that the time window in which further driving-in processes can be triggered for each contact trigger actuation, when the trigger 14 is held down, opens again.

The invention claimed is:

1. A pneumatic nailer comprising a working piston which is connected to a driving plunger for driving in a fastening means and which is subjected to compressed air when a driving-in process is triggered, and a triggering device which has a manually actuatable trigger and a contact feeler, wherein actuating the trigger and the contact feeler together activates a first control valve and can trigger a driving-in process, characterized by a second control valve which is activated when actuating the trigger independently of an actuation of the contact feeler, a chamber which is either aerated or deaerated via a throttle when the second control valve is activated, and a locking piston which is displaced from a resting position into a locked position when the pressure in the chamber passes a predetermined pressure threshold and which in the locked position prevents a driving-in process from being triggered.

2. The pneumatic nailer as claimed in claim 1, wherein the chamber is deaerated or respectively aerated when the trigger is not actuated.

3. The pneumatic nailer as claimed in claim 1, wherein an opening cross section of the throttle is dimensioned so that, during operation of the pneumatic nailer at an operating pressure provided therefor, the pressure in the chamber passes the predetermined pressure threshold in a time period of 0.1 s to 10 s after the second control valve is activated.

4. The pneumatic nailer as claimed in claim 1, further comprising a valve, via which the chamber is deaerated or respectively aerated when a driving-in process is triggered.

5. The pneumatic nailer as claimed in claim 4, wherein when a driving-in process is triggered, a control chamber is deaerated or respectively aerated as a result of the first control valve being activated, wherein the valve is a non-return valve which connects the chamber to the control chamber.

6. The pneumatic nailer as claimed in claim 5, wherein the non-return valve has an O-ring which is arranged in an internal groove of a sleeve and closes a bore leading from the internal groove to an outer face of the sleeve.

7. The pneumatic nailer as claimed in claim 1, wherein the locking piston in the locked position switches the pneumatic nailer to the fully unpressurized state.

8. The pneumatic nailer as claimed claim 1, wherein the locking piston in the locked position closes a deaeration opening, via which a control chamber is deaerated when a driving-in process is triggered.

9. The pneumatic nailer as claimed in claim 1, wherein the locking piston blocks a line which is aerated or deaerated when the first control valve is activated.

10. The pneumatic nailer as claimed in claim 1, wherein the locking piston is configured to interrupt a non-positive connection between the contact feeler and the first control valve.

11. The pneumatic nailer as claimed in claim 10, wherein a spring which pretensions the locking piston into the locked position.

12. The pneumatic nailer as claimed in claim 10, wherein the locking piston in the locked position blocks a valve element to be moved for triggering a driving-in process.

13. The pneumatic nailer as claimed in claim 12, wherein the valve element to be moved is a control piston of a pilot valve.

14. The pneumatic nailer as claimed in claim 12, wherein the valve element to be moved is a main valve-actuating member which closes a working volume above the working piston.

15. The pneumatic nailer as claimed in claim 1, further comprising the locking piston is guided in a cylinder having a cylinder chamber arranged on a first side of the locking piston is connected to the chamber or forms the chamber.

16. The pneumatic nailer as claimed in claim 15, wherein a second side of the locking piston opposing the first side of the locking piston is subjected to compressed air in an initial state of the pneumatic nailer.

* * * * *